United States Patent [19]

Streicher

[11] 4,154,560

[45] May 15, 1979

[54] ENDLESS BELT PUMP

[76] Inventor: Manfred Streicher, Bahnhofstrasse 22, 7141 Beilstein, Fed. Rep. of Germany

[21] Appl. No.: 753,135

[22] Filed: Dec. 22, 1976

[30] Foreign Application Priority Data

Dec. 22, 1975 [DE] Fed. Rep. of Germany ..... 2558074

[51] Int. Cl.[2] ..... F01C 5/02; F04C 5/00

[52] U.S. Cl. ..... 418/4; 418/153

[58] Field of Search ..... 418/4, 152, 153, 154, 418/156; 417/320

[56] References Cited

U.S. PATENT DOCUMENTS

| | | | |
|---|---|---|---|
| 979,324 | 12/1910 | Miner | 418/4 |
| 1,445,721 | 2/1923 | Schleppy | 418/4 |
| 2,355,928 | 8/1944 | Stevens | 418/4 |
| 3,071,078 | 1/1963 | Selby | 418/4 |

FOREIGN PATENT DOCUMENTS

| | | | |
|---|---|---|---|
| 605627 | 2/1926 | France | 418/4 |
| 818091 | 8/1959 | United Kingdom | 418/4 |

*Primary Examiner*—John J. Vrablik

*Attorney, Agent, or Firm*—Sughrue, Rothwell, Mion, Zinn and Macpeak

[57] ABSTRACT

A positive displacement pump includes a flexible endless belt 4 disposed around spaced, parallel drive rollers 8, 9 within a housing 2. The belt is non-extensible in the peripheral direction and carries elastically deformable teeth on its outer surface. The spaces between the teeth form conveying chambers **4*b* whose volumes vary in an expansion-contraction sense as the belt runs around a roller between inlet and outlet openings 11, 13** in the housing.

2 Claims, 7 Drawing Figures

ENDLESS BELT PUMP

BACKGROUND OF THE INVENTION

The invention relates to a positive displacement pump with a pump housing which has inlet and outlet openings in which an endless transportation belt revolves around at least two reversing rollers of which at least one is driven, and whereby the endless belt has recesses on at least one of its surfaces which, during the revolutions of the belt form conveying chambers of periodically variable volumes.

Positive displacement pumps of this type have already been known. A pump with an endless flat belt has been known f. ex. from the U.S. Pat. No. 2,355,928, which revolves around two reversing rollers and which on its inside has V-shaped notches which serve as conveying chambers of variable volumes. The liquid that is to be conveyed is fed to the space between the two reversing rollers, it there reaches the V-shaped notches of the belt, and upon running up said belt it is squeezed out onto one of the rollers laterally from the notches. The liquid reaches a chamber which is connected with an outlet line.

From the British Pat. No. 818,091, a similar positive displacement pump has been known in the case of which an inside toothed V-belt is used instead of a flat belt, which revolves around two pulleys. Since the pulleys will not permit a lateral emergence of the conveyed liquid from the V-shaped notches, said liquid must leave radially toward the inside and must be fed via the pulley shaft developed as a housing shaft to an outlet line.

These known constructions of positive displacement pumps have the disadvantage that the conveyed quantity is limited because of the tight outlet channels and in that it cannot be used for the conveyance of contaminated liquid or liquid enriched otherwise with solid bodies. The solid bodies which have entered the conveying chambers are forced to the outside under the action of the centrifugal forces in the chambers and they can no longer emerge on the places provided for this purpose. They remain jammed in the chambers of the revolving belt and they will cause a quick destruction of the latter. In addition the narrow outlet chambers and channels necessary in the case of these pump constructions are quickly plugged up. A further disadvantage of this type of pump construction is that the liquid that is to be conveyed must be fed to the inside space between the reversing rollers where it also enters the V-shaped notches of the strand of the belt which is not intended for conveyance. In the case of the revolution of this strand of belt around the counter roller, whirls develop in the housing which lead to cavitation phenomena and to losses in the degree of effectiveness.

SUMMARY OF THE INVENTION

It is the task of the invention to avoid the above mentioned disadvantages in the case of a positive displacement pump of the initially mentioned type, and to develop the pump in such a way that considerably greater quantities of conveyance and higher pressure of conveyance can be achieved and that even liquids which contain solid bodies and even viscous substances as they are found in sewage plants, can be conveyed.

According to the invention this task is solved through the fact that the conveying chambers formed by recesses in the belt are disposed on the outside of said belt and in that at least in the area of one reversing roller, the inside of the housing encloses the belt laterally and on its outside surface between one inlet opening and one outlet opening, in order to close the conveying chambers.

As a result of this construction the following advantages will be achieved: The liquid that is to be conveyed leaves on the outside of the belt and passes into an area in the housing which lies between the starting area and the terminal area of the reversal of the belt around a roller. The outlet follows the housing directly without any intermediate channels. The liquid conveyed in the V-shaped notches is not guided away in the outlet zone exclusively by the narrowing down of the V-shaped notches but also as a result of the action of the centrifugal force. As a result of that a considerable increase of the conveying performance will be achieved at a certain pump size and solid bodies in the liquid cannot be jammed. The liquid that is to be conveyed practically does not reach the inside space of the housing between the reversing rollers either so that no unnecessary losses can occur as a result of turbulent movement etc. A further advantage of the pump according to the invention is that it is double acting, that it therefore operates in both rotational directions.

It is true that from the U.S. Pat. No. 2,745,355, a positive displacement pump with an endless conveying belt has already been known, which belt also has a toothing on the outside. However, in that case, we are not dealing with a pump of the initially mentioned type with conveying chambers, the volumes of which changes periodically during the revolution of the belt. The belt of this pump operates in accordance with the principle of a geared pump and requires a third toothed roller, the teeth of which displace the conveyed liquid during engagement with the outside toothing.

BRIEF DESCRIPTION OF THE DRAWINGS

In the following pages a few embodiments of the object of the invention will be explained in more detail on the basis of schematic drawings.

DETAILED DESCRIPTION OF THE PREFERRED EMBODIMENTS

Figure 1:
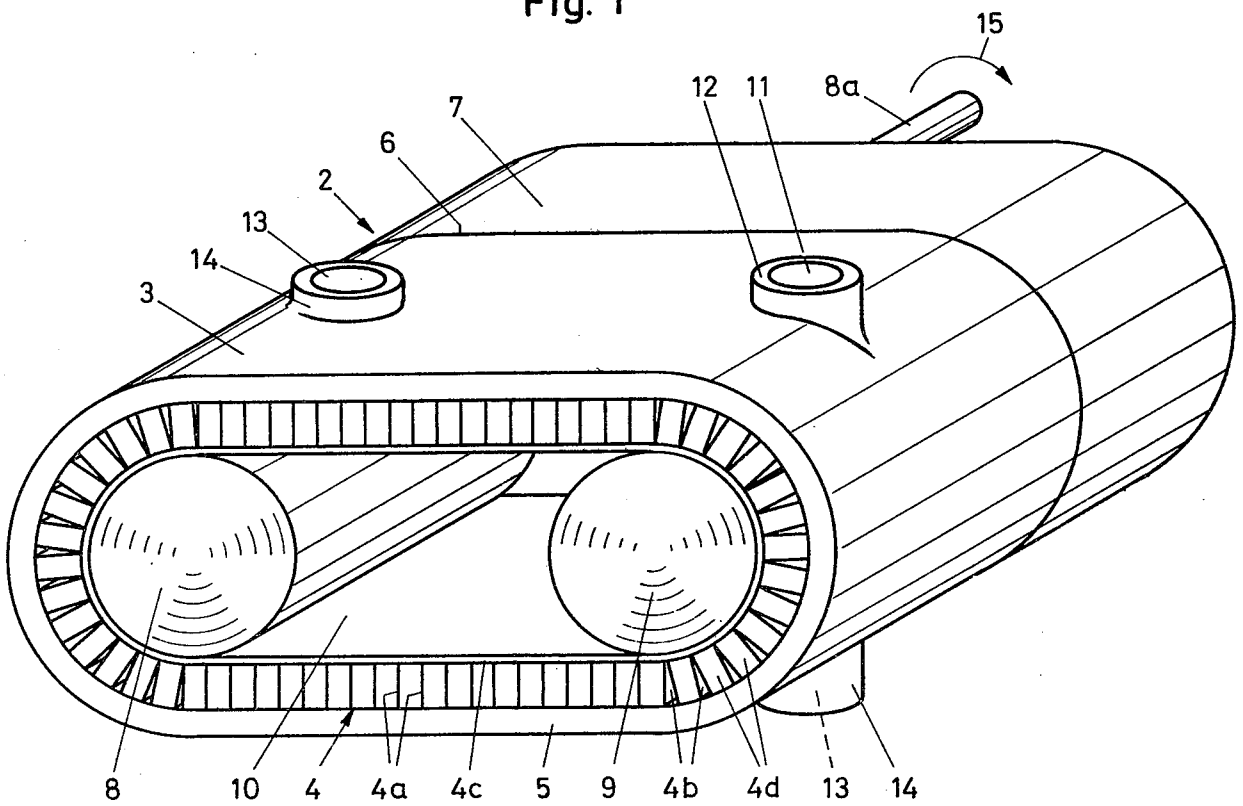
FIG. 1 shows a schematic perspective view of a first embodiment of the positive displacement pump with the front housing cover removed.

The positive displacement pump shown in FIG. 1 has for its main construction elements a pump housing 2, an endless conveyor belt 4 and two reversing rollers 8 and 9 around which the conveying belt 4 revolves.

The housing 2 has a housing body 3 and has been adapted precisely to the peripheral shape of the conveyor belt 4. It therefore has two flat wall parts which are followed (connected) by wall parts bent semicircularly. It has two front surfaces 5 and 6 parallel to one another which are closed by housing covers of which only the rear cover 7 has been shown. The two housing covers join up closely with the lateral walls of the conveyor belt 4 and the front sides of the reversing rollers 8 and 9. The inside space 10 is limited by the belt 4 and the reversing rollers 8, 9.

Figure 5:
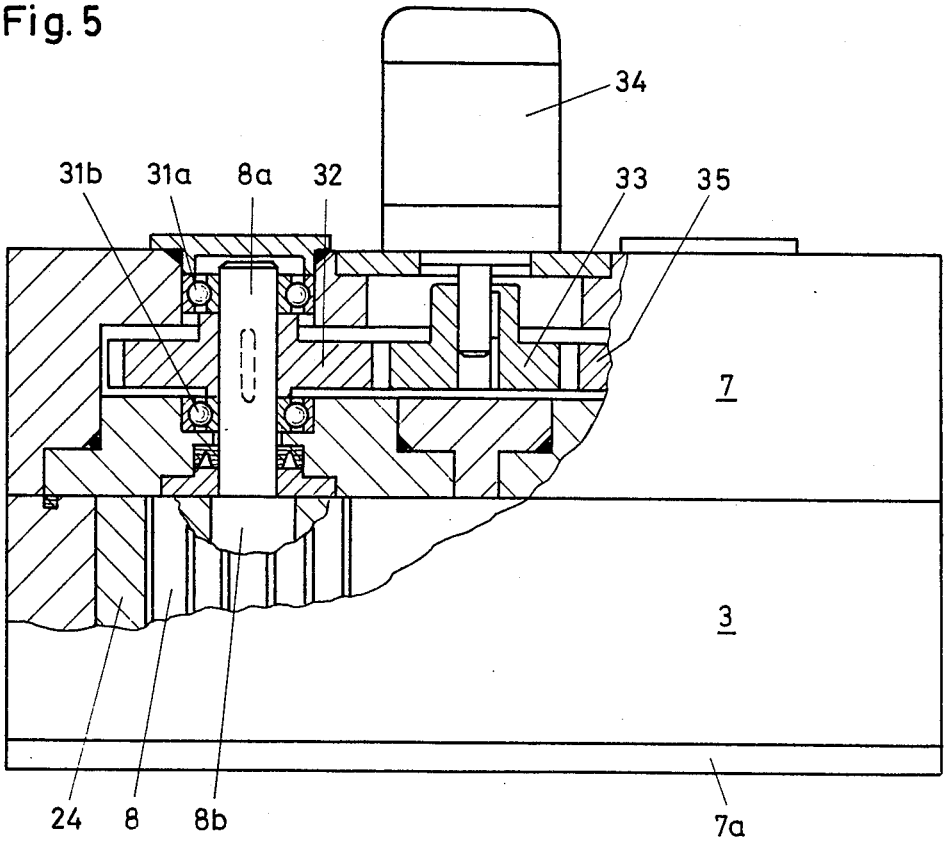

The reversing rollers 8, 9 are taper-bore mounted in a similar manner in the rear housing lid 7 as shown in FIG. 5 for another embodiment of a positive displacement pump. The reversing roller 8 has a driving shaft 8*a* projecting from the rear cover 7, which is connected with a driving motor, not shown. But it would also be possible to drive both reversing rollers 8, 9 as will still be described in connection with the embodiment according to FIG. 5.

The housing body 3 at those places where the flat housing part passes over into the semicylindrically arched housing part always has an inlet opening 11 with a connecting sleeve 12 and an outlet opening 13 with a connecting sleeve 14.

Figure 6:
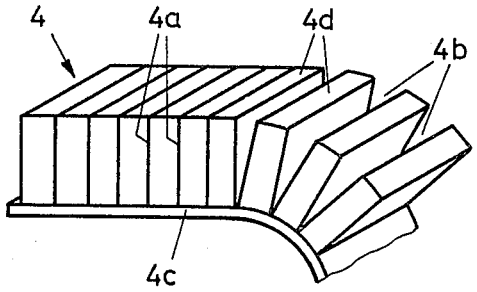
FIG. 5 is a top view of the embodiment according to FIG. 4 partially in cut following the line V—V and FIGS. 6 and 7 are perspective views of variously developed sections of conveying belts.

The endless conveyer belt 4, of which a section is shown separately in FIG. 6, consists preferably of reinforced plastic. However, it must be pliable and not expansible in peripheral direction. The belt 4 is rectangular in its cross section and it has notches 4*a* running transversely to its longitudinal direction so that toothlike displacement elements 4*d* are formed which upon reversal of the belt 4 around the rollers 8, 9 will form V-shaped conveying chambers 4*b*. The carrier part 4*c* resting directly on the rollers 8, 9 has no notches 4*a* and is dimensioned according to the requirements of a sufficient tensile strength.

The method of operation of the positive displacement pump 1 is as follows: In the case of the revolution of the conveyer belt 4 in the direction of the arrow 15, the medium that is to be conveyed is sucked in through the inlet opening 11 by the chambers 4*b* opening up in a V shape, it is conveyed by about 180° and is then forced out from the gradually again diminishing chambers 4*b* through the outlet opening 13. The conveying action is supported by the centrifugal forces acting in the reversing zones of the belt 4 on the conveyed medium. The pump 1 operates as a double flow pump, it has two inlets and two outlets, and it can also operate with the reversed rotational direction, whereby then the inlet and outlet openings are exchanged.

Figure 2:
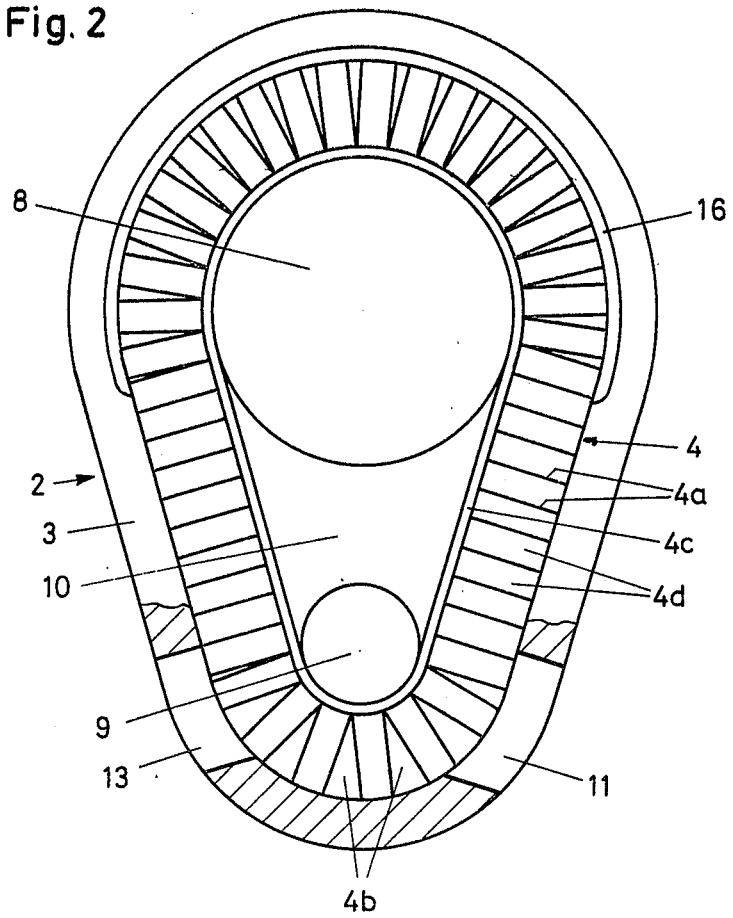
FIG. 2 shows a schematic side view of a second embodiment of the positive displacement pump shown partially in cut with the front housing cover removed.

In the case of the conveying pump shown in FIG. 2, the two guide drums 8 and 9 have outside diameters which differ from one another. The conveyor belt 4 has basically the same structure as that of the positive displacement pump according to FIG. 1. It has a carrier part 4*c* and on its outside toothlike displacement elements 4*d* with rectangular cross section and recesses 4*b* with V-shaped cross section.

The path of movement of the conveyer belt 4 is less curved on the stretch encircling the larger reversing drum 8 and is more curved on the section encircling the smaller drum 9, as is the case with the two equal sized reversing drums 9 and 8 of the positive displacement pump according to FIG. 1. The conveying chambers 4*b* of the conveyer belt 4 have a correspondingly larger volume on the section of their path of movement leading around the smaller guide drum 9 and have a smaller volume on the section leading around the larger drum 8. For this reason, this positive displacement pump on its housing body 3 has only one inlet opening 11 and one outlet opening 13 adjacent to the smaller reversing drum 9. The positive displacement pump therefore has only a single flow but likewise operates in both directions of rotation. The volume of the recesses 4*b* is smaller on the section leading around the larger drum 8 than in the area of the smaller drum 9. In the case of the transition of the recesses 4*b* from the straight stretch to the stretch leading in the form of an arch around the drum 8, a sucking action occurs inside the housing. In order to eliminate the danger of cavitation existing as a result of that during the conveyance of liquids and in order to not increase the pressure gradient from the outlet opening up to the point of transition of the two sections of the path of movement, an equalizing channel 16 is available in the housing body 3.

The equalizing channel 16, instead of being disposed in the housing body 3, could also be disposed in one and/or the other of the two housing lids not shown in FIG. 2.

Figure 3:
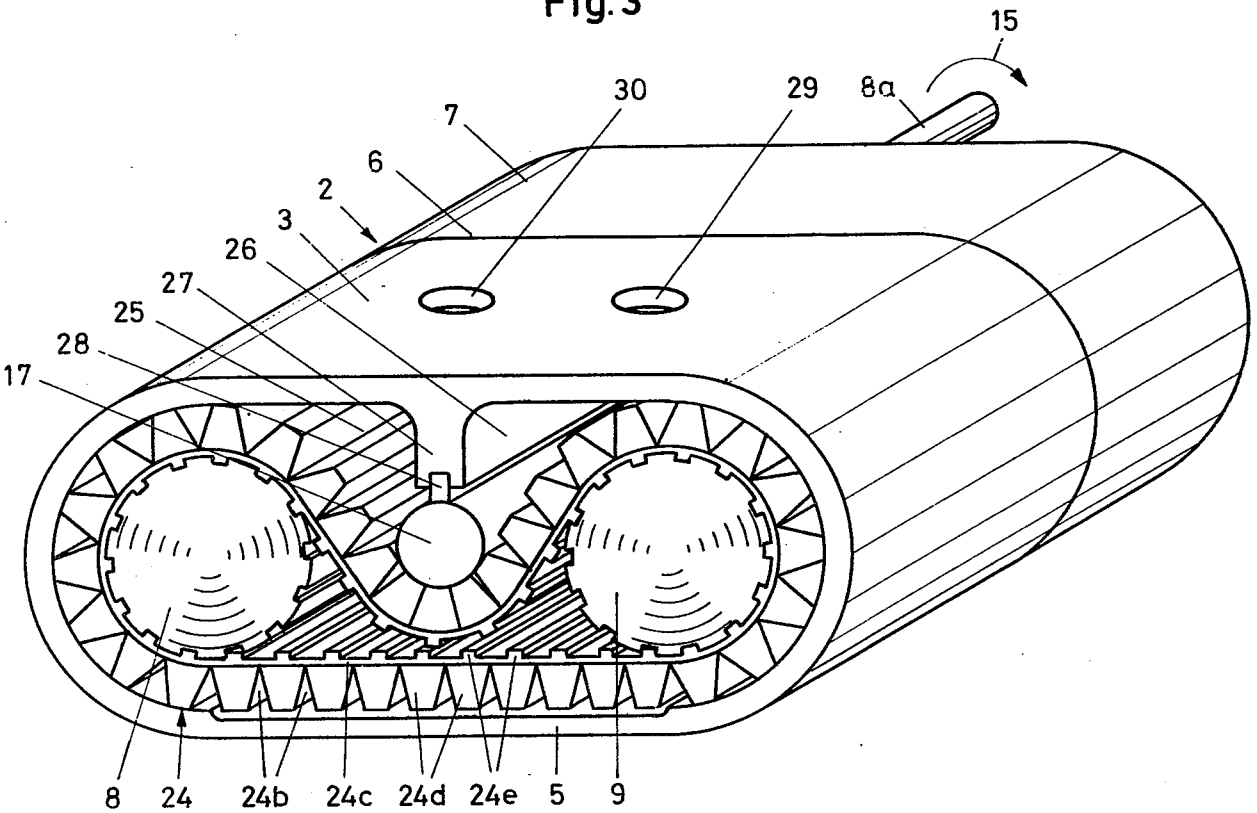
FIG. 3 is a schematic perspective view of a third embodiment of the positive displacement pump with the front housing cover removed.

In the case of the positive displacement pump shown as a third embodiment in FIG. 3, the two reversing rollers 8, 9 are again of equal size. They are again taper-bore mounted in the rear housing lid, as in the embodiment according to FIG. 1.

Deviating from the embodiments described hitherto, this positive displacement pump has a reversing roller 17 for the conveyer belt 24 in the inside space of its housing body 3. The reversing roller 17 is rotatable parallel to the guide drums 8 and 9. It is disposed in the body of the housing 3 in such a way, that it will reverse the strand of the conveyer belt 24 by a certain stretch in the direction toward the other strand of the conveyer belt 24. The path of movement of the reverted strand of the conveyer belt 24 is given thereby a concavely bent (arched) section with regard to the outside of the conveyer belt 24 leading around the reversing roller 17. Two straight sections follow this section on both sides which at their ends always pass over into the section leading around the reversing drum 8 or 9. The path of movement of the not reversed strand runs straight between the two reversing rollers 8 and 9.

Figure 7:
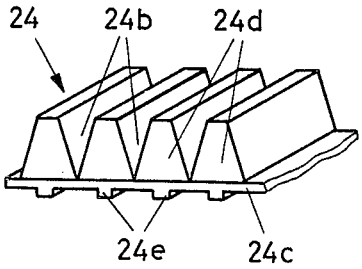

The conveyer belt 24 is shown separately in FIG. 7. It has a carrier part 24*c* and on its outside the displacement elements and the recesses 24*b* lying in between. These recesses 24*b* have a V-shaped cross section in the straight section of the belt 24. The angle of the V-shaped recesses 24*b* has been selected such that the lateral surfaces of limitation of the displacement elements 24*d* fit straight against one another when they encircle the reversing roller 17 and the recesses lying inbetween have a zero volume. As a result of this development of the recesses 24*b* and of the displacement elements 24*d*, and as a result of the reversal of the belt 24 by means of the reversing roller 17, the difference between the maximum value and the minimum value of the volume of the recesses 24*b* becomes larger than in the case of the embodiments described hitherto. On its inside the belt 24 has a toothing 24*c* with which it engages with a corresponding toothing of the reversing rollers 8, 9.

During revolutions of the belt 24 in clockwise direction, the displacement elements 24*d* in the case of the place of transition located on the left side in FIG. 3, swing together from the straight to the concave arched section of their path of movement and in the case of transition located on the right side, they again swing apart. As a result of that the part located to the left of the reversing roller 17, of the space developed as a result of the reversal of the belt 24 between it and the housing body 3, will become a pressure chamber 25, and the part located on the right will become a suction chamber 26. In order to separate the pressure chamber 25 from the suction chamber 26, the housing body 3 is brought up to the reversing roller 17 by means of a housing rib 27 and in addition, there is a sealing strip 28 between the housing rib 27 and the reversing roller 17.

In the upper wall of the housing body 3, there is the inlet opening 29 and the outlet opening 30. The medium that is to be conveyed flows via the inlet opening 29 into the suction chamber 26. From there, the recesses **24*b* of the belt 24 during their revolution around the two reversing rollers convey it into the pressure chamber 25. From there, it is forced out of the pump through the outlet opening 30**.

Figure 4:
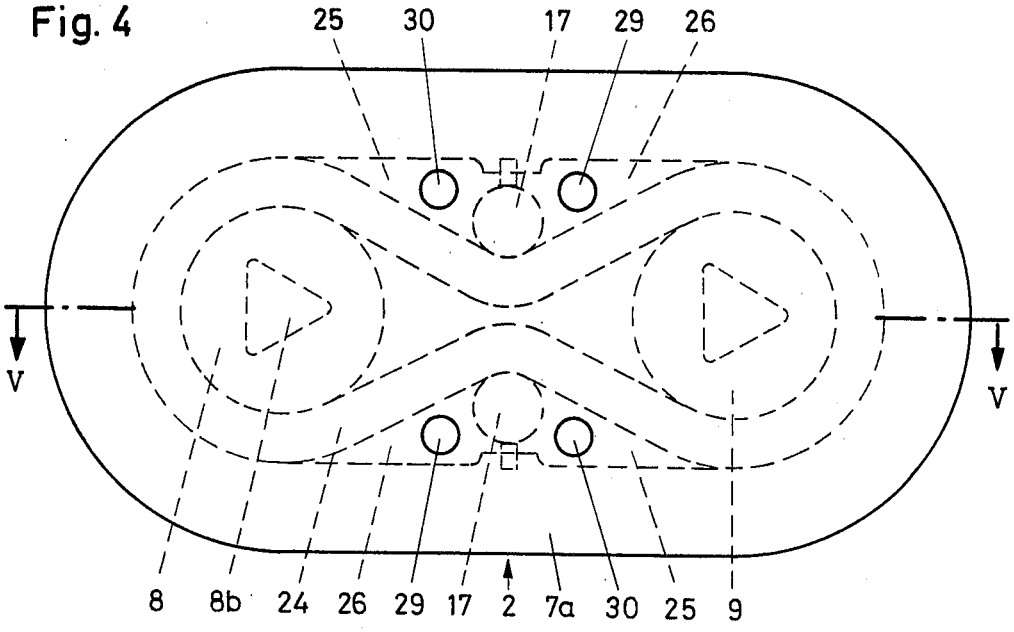
FIG. 4 is a view of a variation of the embodiment according to FIG. 3.

The FIGS. 4 and 5 show an embodiment of a positive displacement pump which differs from that according to FIG. 3 essentially only through the fact, that there are two additional reversing rollers 17 in the housing between the inside reversing rollers 8, 9. This pump likewise contains a belt 24 according to FIG. 7. The method of operation corresponds to that of the pump according to FIG. 3, however, in this case, there always are two suction chamber 26 with inlet openings 29 and always two pressure chambers 25 with outlet openings 30. Consequently, this pump operates with double flow.

In the case of pumps of this type, it may be effective to drive the two outside reversing rollers 8 and 9. FIG. 5 shows the drive and the mounting of the reversing rollers 8 and 9. The pump housing consists of the pump body 3, the rear housing cover 7 and the front housing cover **7*a*. The shaft 8*a* of the reversing roller 8 is mounted in the rear housing lid in two ball bearings 31*a*, 31*b*. On the shaft 8*a*, there is a pinion 32. The latter meshes with a pinion 33 which is seated on the shaft of an electromotor 34 and also drives the pinion 35 of the reversing roller 9. In order that the belt 24, after removal of the front lid 7*a*, can be replaced easily, the reversing rollers 8 and 9 are effectively developed removable from their driving shafts and f. ex. as indicated in FIGS. 4 and 5, are placed on stub shafts 8*b*** which are triangular in their cross section.

I claim:

1. A positive displacement pump, comprising:

(a) a pair of spaced, parallel, generally cylindrical rollers, (b) means for rotatably driving at least one of said rollers, (c) an endless belt disposed around said rollers and formed of a flexible elastic material reinforced so as to be non-extendable in the peripheral direction of said belt, (d) at least one additional roller disposed between said pair of rollers on the outside of one linear run of the belt for concavely reversing said run towards the other linear run of the belt, (e) a plurality of teeth extending outwardly an equal distance from the other surface of said belt, (f) said teeth being disposed in close, side-by-side proximity to one another and being elastically deformable, and (g) a housing member sealingly enclosing both ends of at least one of said rollers and both sides of said belt and teeth at least in the vicinity of said one roller, and sealingly enclosing the other peripheries of said teeth at least in the vicinity of said one roller between inlet and outlet openings disposed in said housing member, to form variable volume conveying chambers in recesses between said teeth during the rotation of said belt, whereby a liquid being pumped is expelled radially outward from said conveying chambers as their volume decreases when the belt leaves said one roller, said centrifugal force aids the expulsion of the liquid and any solid particles entrained therein.

2. Positive displacement pump as in claim 1, characterized in that the belt (4, 24) has teeth on its inside surface which engage corresponding teeth on the surface of the rollers (8, 9).

* * * * *